US007513791B1

(12) United States Patent
Gary

(10) Patent No.: US 7,513,791 B1
(45) Date of Patent: Apr. 7, 2009

(54) ADJUSTABLE POWER CORD RETAINER AND METHOD OF USE

(75) Inventor: McLeod Gary, Flagstaff, AZ (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 11/951,554

(22) Filed: Dec. 6, 2007

(51) Int. Cl.
*H01R 13/62* (2006.01)

(52) U.S. Cl. ..... 439/373

(58) Field of Classification Search ..... 439/371–373
See application file for complete search history.

(56) References Cited

U.S. PATENT DOCUMENTS 4,204,738 A * 5/1980 Tillotson ..... 439/369
5,593,313 A 1/1997 Shibuya et al.
5,860,827 A 1/1999 Lee
6,676,435 B2 1/2004 Momiyama
6,739,896 B2 * 5/2004 Sivertsen ..... 439/371
6,767,237 B1 * 7/2004 Shih ..... 439/371
6,939,161 B1 9/2005 Yi et al.
6,966,792 B1 11/2005 Willers et al.
7,101,215 B2 9/2006 Woellner et al.
7,104,830 B1 9/2006 Diaz
7,134,902 B1 11/2006 Lewis et al.
7,140,903 B2 11/2006 Pulizzi et al.
7,232,330 B2 6/2007 Woellner et al.

* cited by examiner

*Primary Examiner*—Alexander Gilman
(74) *Attorney, Agent, or Firm*—BainwoodHuang

(57) ABSTRACT

A retainer for use with a conventional cord to stabilize the cord within a plug of an electronic device is provided. The retainer includes a bushing for receiving the cord, and a bail, which engages the bushing at one end, having a pair of legs for engagement with a pair of corresponding holders supported on the electrical device to secure and stabilize the cord. The legs include a pair of engagement members that face inwardly, toward the opposing leg, and which are received within a holder supported on the electronic assembly so that the engagement members face inwardly, toward each other during use. In one embodiment, a locking ring is provided for engaging the bushing to tighten the fit of the bushing over the cord.

21 Claims, 15 Drawing Sheets

ADJUSTABLE POWER CORD RETAINER AND METHOD OF USE

BACKGROUND

Power cords are utilized in a wide variety of electrical applications to make and maintain an electrical connection between a power source and a device. Power cords come in a variety of shapes and sizes. Conventional cords include a cable and a socket at one end that is friction fit into a mating plug having one or more prongs, and can be easily removed by a user. Alternatively, the cord may include the prongs that are friction fit into a mating outlet or socket. Power cords that rely upon a friction fit can become inadvertently disconnected during use, particularly in environments that are subject to vibration, or during maintenance of nearby equipment. Regardless of the reason, if a power cord becomes disconnected, the supply of power is interrupted, which can result in the associated network going down.

One solution to the problem of accidental removal of the cord is to secure the cord with a fastener. For example, data cables between computers and peripherals often utilize screws or other fasteners that are integrated into the plug of the power cord. Although effective, the cords are very specific in their design. New cords with the latest attachment mechanism may not match with older equipment, and vice versa.

Another solution has been to provide a wire bail that is secured over the cord by fasteners disposed on either side of the plug. The effectiveness of this solution is also limited by the inability to accommodate a variety of power cords and the use of mechanical retention fasteners.

Accordingly, it is desirable to provide a device for securing a power cord that allows a technician to fasten and secure the device efficiently and effectively to a variety of power cords having different external sizes and shapes. In addition, it is desirable to provide an apparatus that allows the technician to connect and secure the power cord without the need for specialized tools.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Overview

Figure 1:
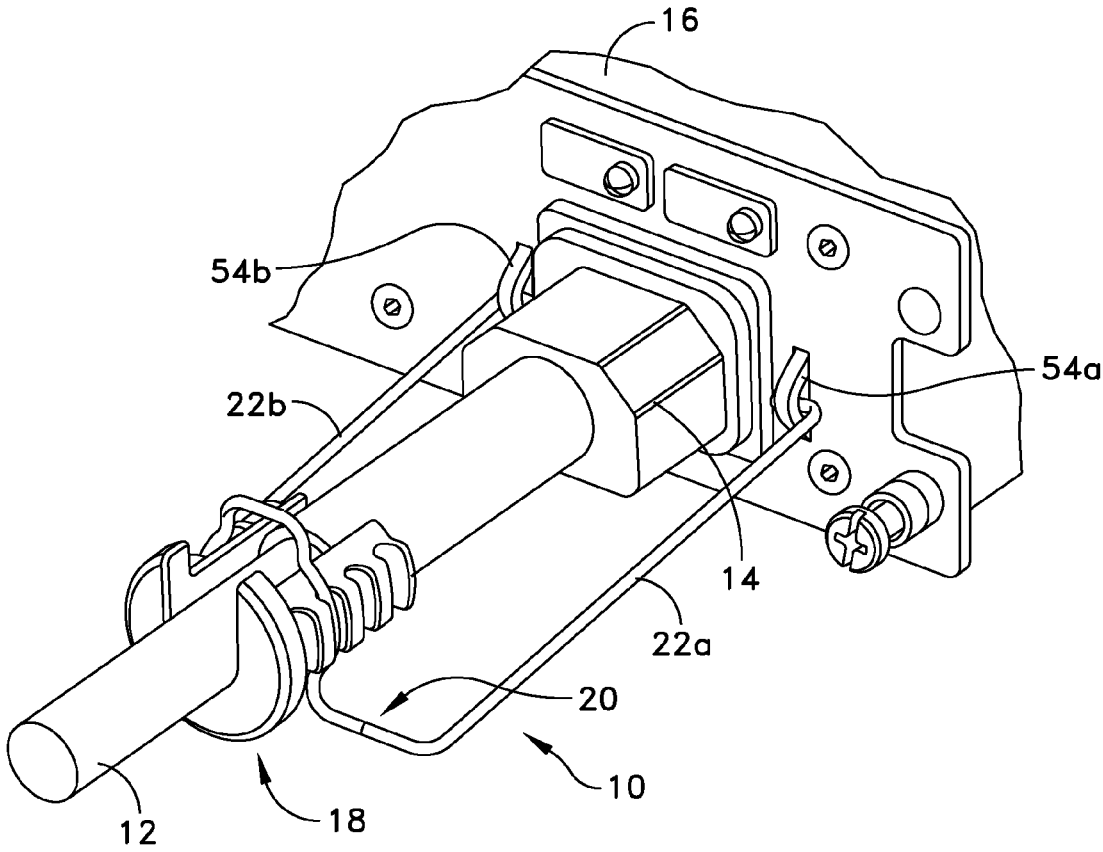
FIG. 1 is a perspective view of a first embodiment of an adjustable retainer for a power cord secured to a chassis.

A power cord retainer assembly for securing a power cord within a plug includes a bushing having a housing with an outer surface and an inner surface, the inner surface defining a channel to receive the power cord therein, the outer surface including one or more slots formed thereon, and a bail having a support element to maintain the bail within one of the slots of the bushing, and defining an opening sized to receive the bushing. The bail also includes a pair of opposing legs, each leg including a first end supported by the support element and extending there from, and a second end, opposite the first. An engagement member extends from the distal end of each leg and faces inwardly, in a direction toward the opposite leg. A first holder and a second holder are also provided which receive a corresponding engagement member, the first holder being positioned on one side of the plug, and the second holder being positioned on the other side of the plug. In use, the engagement member of each leg is inserted within the corresponding holder from an outboard side of the holders so as to receive the engagement portions within the holders in a direction facing inward, toward the socket, and are rotated to position the bail over the cord, the cord being inserted within the channel of the bushing and into the socket. The cord is secured within the socket by the bail supported at one end within one of the slots of the bushing, and at the other end by each of the engagement portions received within the holders and facing inward, toward the socket. A method of using the power cord retainer is also described.

A power cord retainer for securing a power cord within a socket that includes a locking ring is also provided. The power cord retainer includes a bushing having a housing with an outer surface and an inner surface, the inner surface defining a channel to receive the power cord therein, the outer surface including one or more slots formed thereon and a bail having a support element to maintain the bail within the one or more slots of the bushing, and defining an opening to receive the bushing therein. The bail also includes a pair of opposing legs, each leg including a first end supported by the support element and extending there from, and a second end, opposite the first. An engagement member extends from the distal end of each leg which engages a corresponding holder supported on either side of a socket of the electronic device during use. An adjustable locking member having an inner surface to engage the outer surface of the bushing is also provided. During use, the locking member engages the bushing and is selectively moved along the housing in order to tighten the fit between the bushing and the cord.

DESCRIPTION OF EXAMPLE EMBODIMENTS

The embodiments disclosed herein relate to an adjustable retainer for use with a power cord. As used herein, the term "cord" and "power cord" is used in the conventional manner to describe a cord including an electric cable having a female socket at one end for connecting to a male plug having prongs supported on the electronic device, and the reverse configuration where the cable has a plug at one end for connecting to a socket, so as to make and maintain an electrical connection between a power source and a device. Although the present application will make reference to a generalized power cord for connection to a device, the retainer is intended to be used with power cords having a variety of shapes, sizes and applications. As also used herein, the term "electronic devices" refers to any electronic devices, modules, components, hardware, and/or equipment, including but not limited to server computers, mass storage devices, and telecommunications equipment, as would be known to one of skill in the art.

Referring initially to FIGS. 1-3B, an example retainer 10 for use with a conventional cord 12 to stabilize the cord within a receptacle of an electronic device 16 is illustrated. The example retainer 10 includes a bushing 18 for receiving the cord 12, a bail 20 which engages the bushing at one end and which includes a pair of legs 22*a*, 22*b* for engaging a pair of corresponding holders 24*a*, 24*b* in order to secure the power cord to the electronic device, as described in greater detail below.

Figure 2:
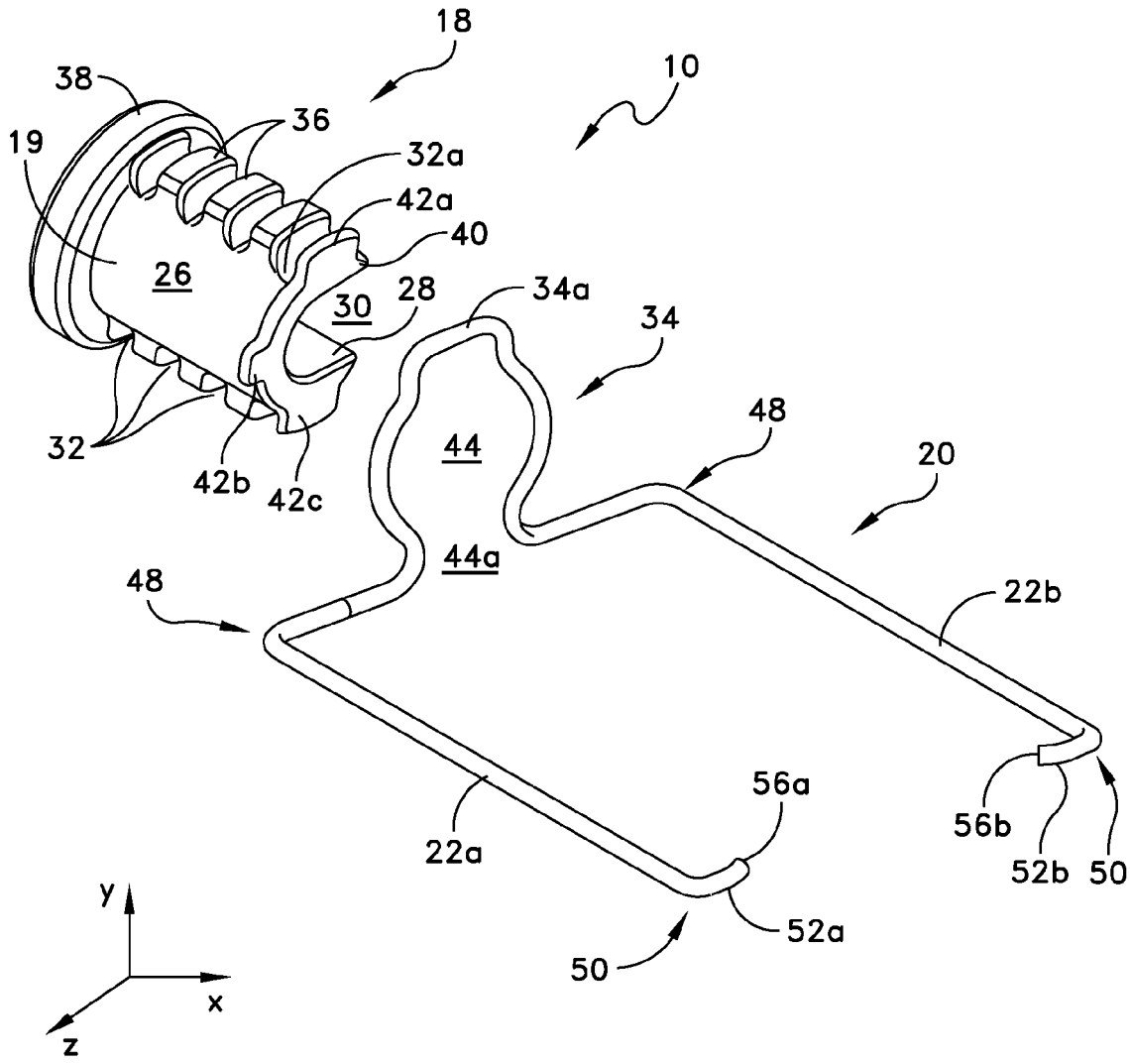
FIG. 2 is an exploded perspective view of the retainer of FIG. 1 including a bushing and a bail in an unsecured position.

As best illustrated in FIG. 2, the bushing 18 includes a housing 19 which may have a generally cylindrical shape, and which has an outer surface 26 and an inner surface 28. The inner surface 28 defines a channel 30, which is sized to receive the power cord therein. In the present embodiment, the width, "w" of the channel (FIG. 3B) may be in the range of about 0.41 to 0.45 of an inch, so at to accommodate power cords with a cable ranging in size from about 0.25 to about 0.4 inch in diameter. The outer surface 26 of housing 19 includes one or more slots 32 formed thereon which are sized to engage a support element 34 of the bail so that the overall length, "L" (FIG. 3B) of the combination of bushing 18 and bail 20 can be adjusted, according to the particular cord being secured. In the present embodiment, the slots 32 are formed between a plurality of ribs 36 supported on the outer surface of the bushing. Although a total of four adjustment slots are illustrated, more or less slots may be provided, as would be known to those of skill in the art. Bushing 18 may also include a base 38 and a collar 40. In the present embodiment, the collar includes one or more tabs 42*a, b, c* for abutting the support element of the bail when it is disposed in the first slot 32*a*, as described in greater detail below. Bushing 18 may be formed of plastic, or any other suitable material, as would be known to those of skill in the art.

With continued reference to FIGS. 1-3B, bail 20 includes support element 34 which has a shape that generally corresponds to the shape of the bushing 18. Since the bushing of the present embodiment is cylindrical, the bail of this embodiment is formed into a generally circular shape, with a curved or flattened top portion 34*a*. Top portion 34*a* is sized to be received within the one or more slots 32 of the bushing 18 in order to help maintain the bail within the one or more slots in a snap-fit type arrangement. Support element 34 also defines an opening 44 which is likewise sized to receive the bushing therein. The opening of the support element is bounded on all sides, except at bottom 44*a*, which receives the cord during use, as explained in greater detail below. Bail 20 may be formed of wire, or any other suitable material, as would be known to those of skill in the art.

Extending from the support element 34 are the pair of generally parallel legs 22*a*, 22*b*. Each leg 22*a*, 22*b* includes a proximal end 48 adjacent the support element 34, and a distal end 50, opposite the proximal end. The distal end 50 of each leg terminates in an engagement member 52*a*, 52*b* that turns inwardly, in a direction toward the opposing leg. The engagement member 52*a*, 52*b* is designed to releasably engage corresponding holders 54*a*, 54*b* that are supported on a rear surface 56 of chassis 58 (FIGS. 4-13) in order to secure the cord, as described below. In the present embodiment, each engagement member 52*a*, 52*b* further includes an end portion 56*a*, 56*b* that extends from and is bent at an angle with respect to the engagement member, so that the end portion extends further inward toward the other leg than the engagement member. By angling the ends portions in this manner each engagement member is further secured within the corresponding holder during use and is less likely to be inadvertently dislodged.

Referring now to FIGS. 5-12, holders 54*a*, 54*b* are supported by the electronic component, for example chassis 58. Holders 54*a*, 54*b* include a first holder 54*a* supported on one side of receptacle 60, and a second holder 54*b* supported on the other side of the receptacle. In the present embodiment, the holders have an arcuate or "D" shape, and define an opening 62 disposed between the holders and the chassis. Opening 62 is sized to receive the engagement members 52*a*, 52*b*, as described above. The length of the holder is longer vertically, "$l_v$", (y-direction) than it is horizontally, "$l_h$", (x-direction) so as to allow the retainer to be rotated as described in greater detail below.

Figure 3A:
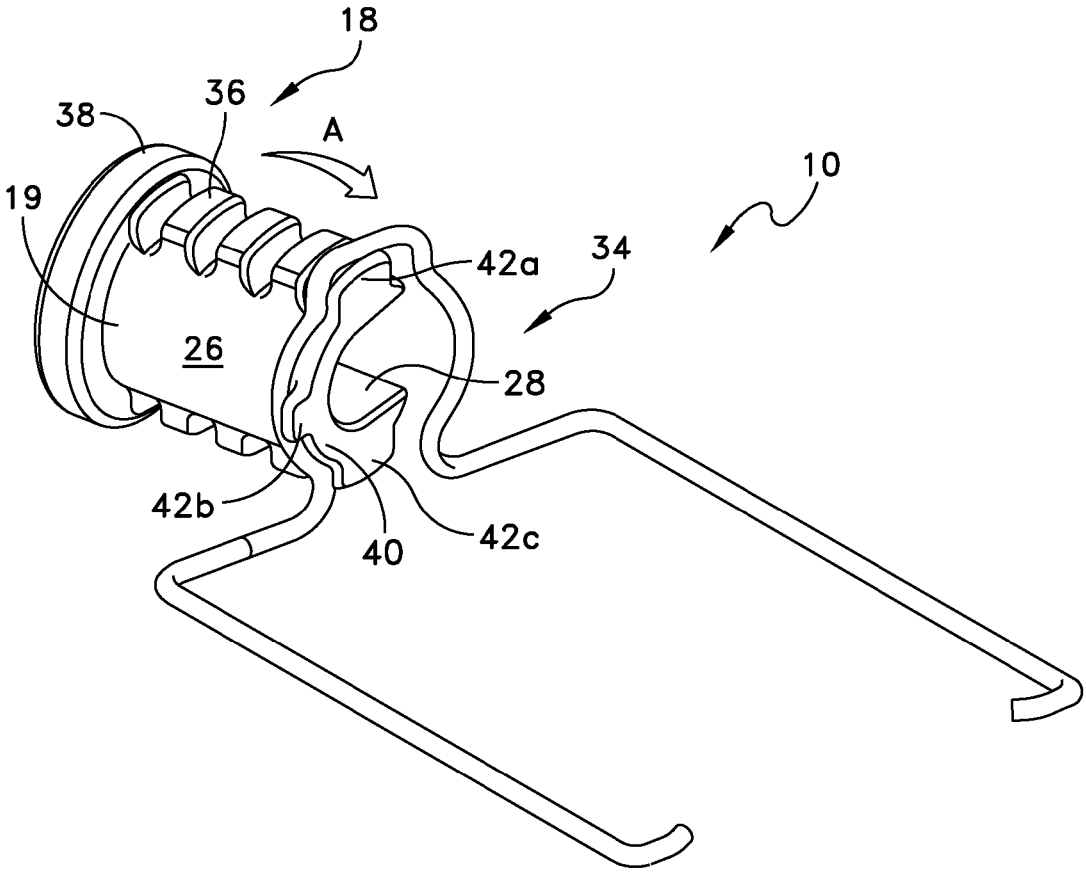
FIG. 3A is a perspective view of the wire bail of FIG. 2 being secured to the bushing.
Figure 3B:
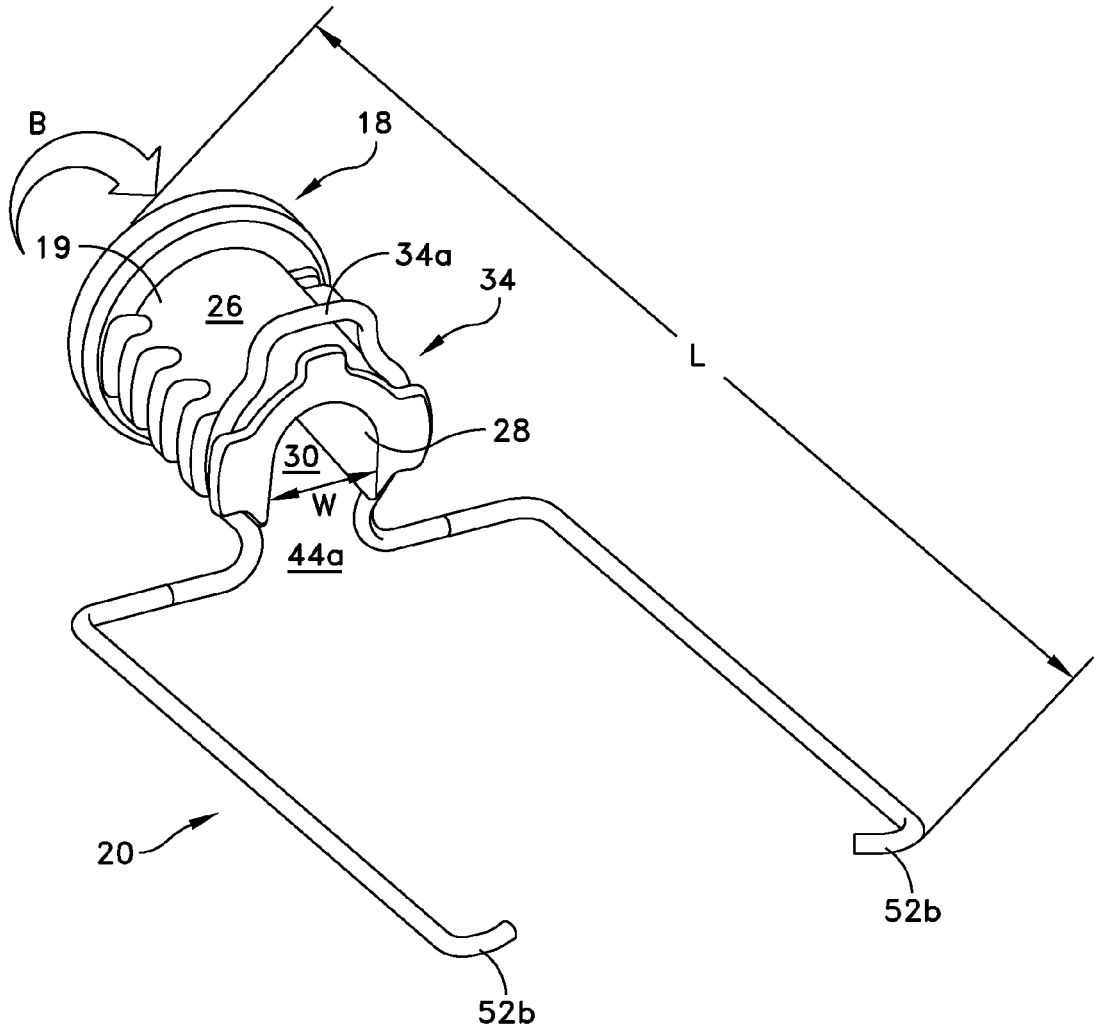
FIG. 3B is a perspective view of the wire bail of FIG. 3A fully secured to the bushing.
Figure 4:
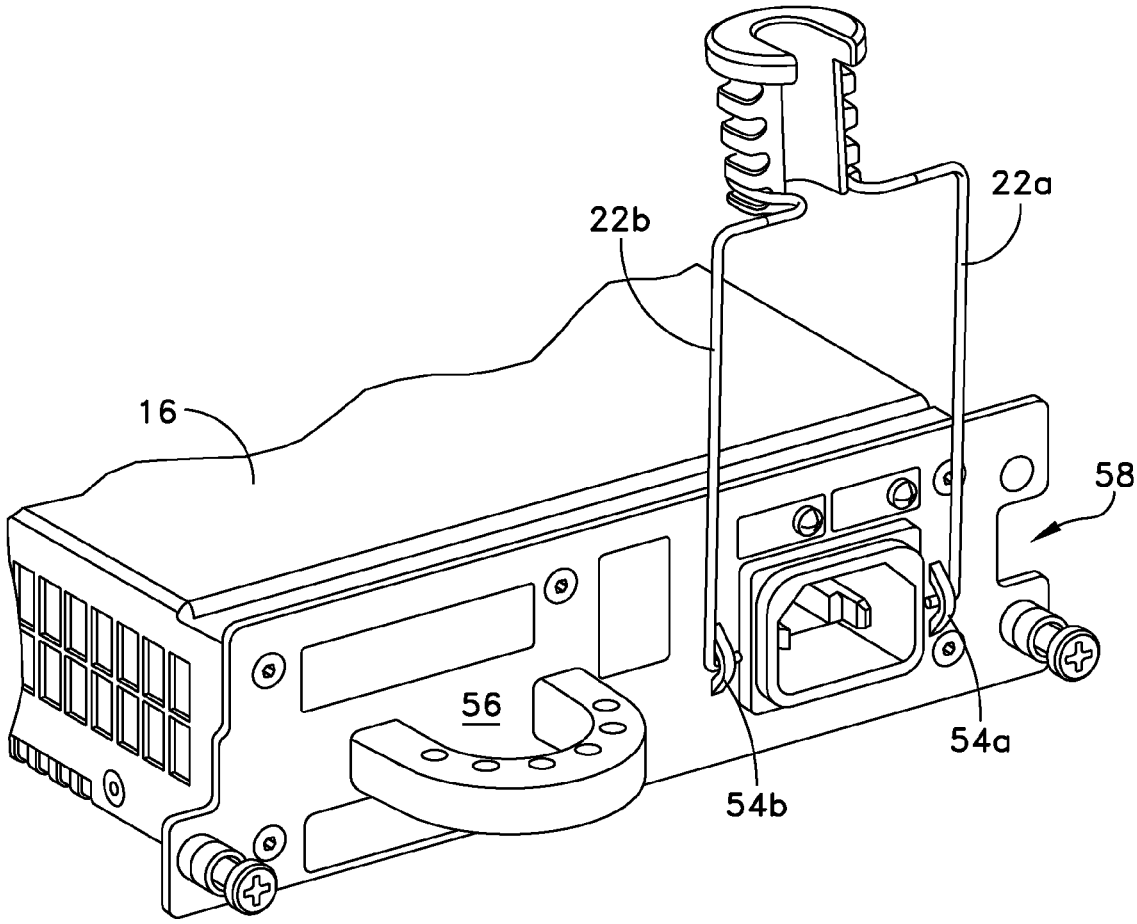
FIG. 4 is a perspective view of the adjustable retainer of FIG. 1 in an upright, initial position secured on the back of a chassis.
Figure 5:
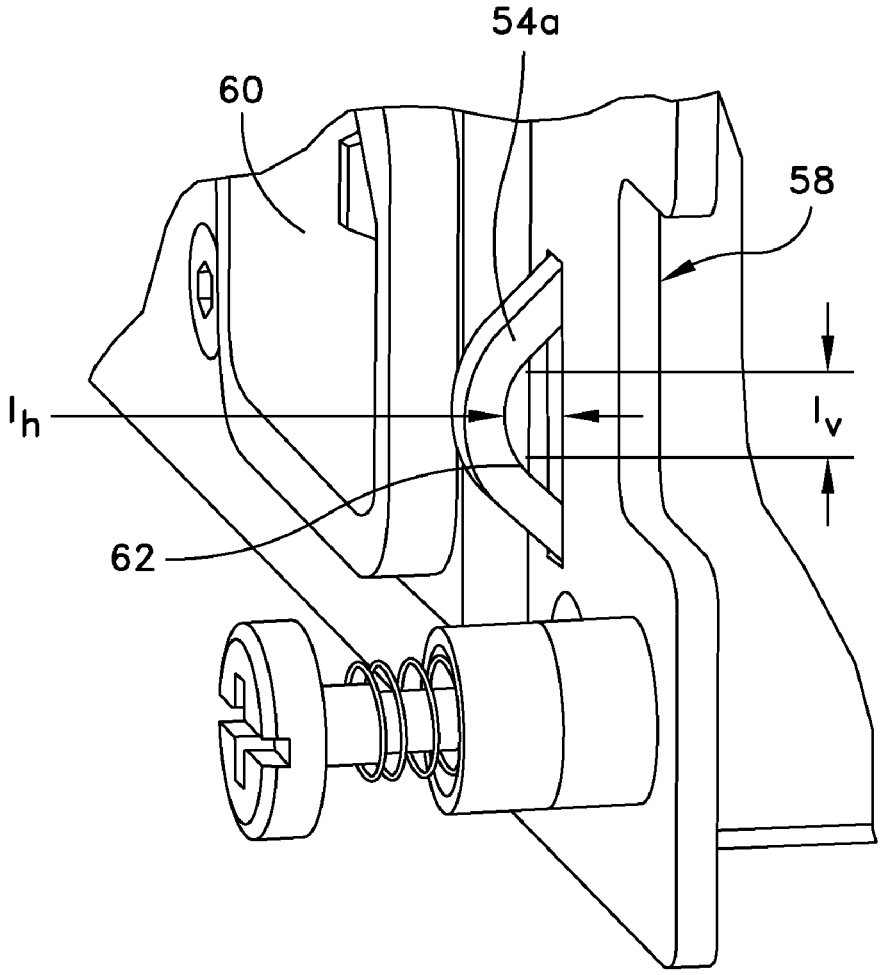
FIG. 5 is an enlarged view of one D-shaped holder of the chassis of FIG. 4.
Figure 6:
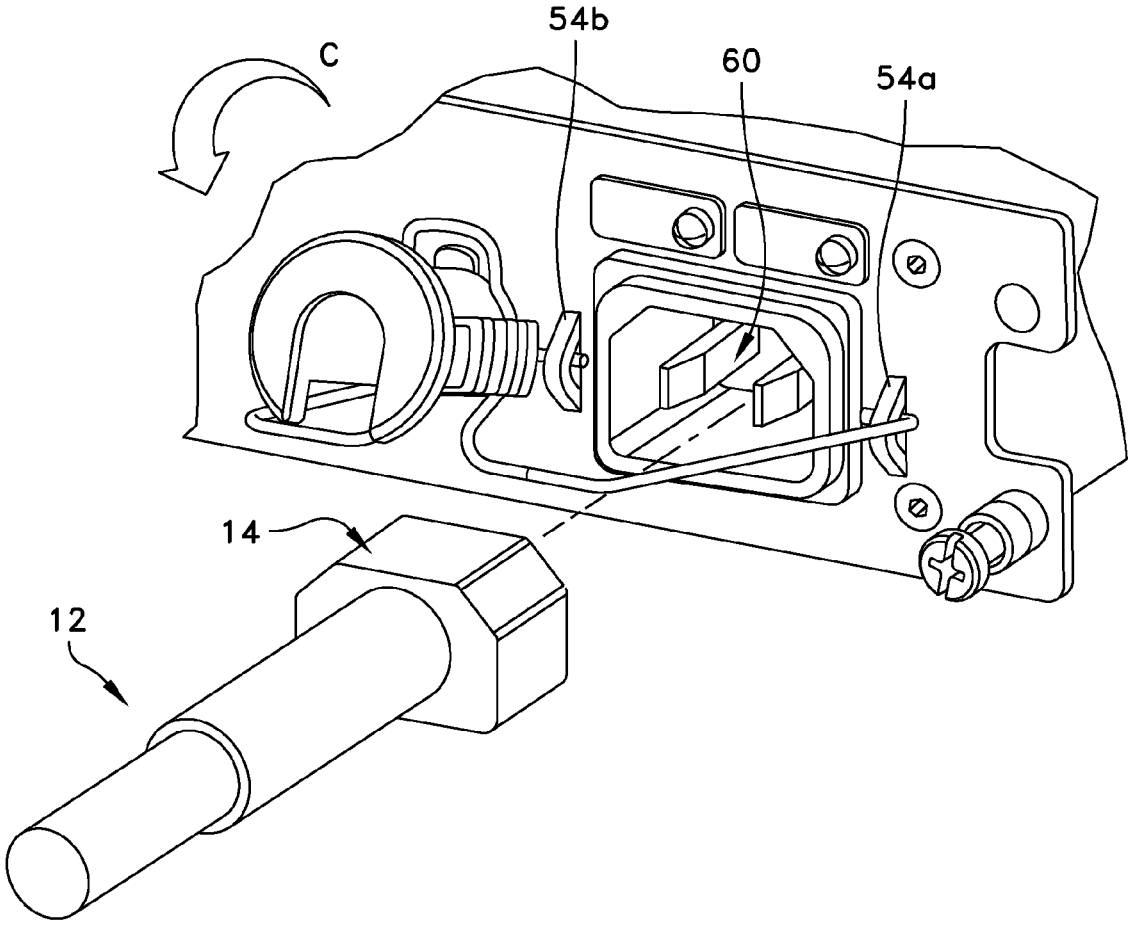
FIG. 6 is a perspective view of the adjustable retainer of FIG. 1 in a rotated, secured position with an unsecured power cord.

Use of the retainer will now be described with reference to FIGS. 1-12. In use, tab 42*a* of bushing 18 is inserted then rotated in the direction of arrow A (FIG. 3A) within the opening 44 formed by the bail 20 (FIG. 3A) so that that the flattened top portion 34*a* of the bail is received within the proximal most slot 32*a* of the bushing. Bushing 18 is then rotated in the direction of arrow B (FIG. 3B) so that the channel 30 of the bushing is aligned with the bottom 44*a* of the opening 44 of the bail. The bushing and bail are now ready to be connected to the electronic device. Referring to FIG. 4, the engagement members 52*a, b* of the bail are inserted from an outboard side into the openings 62 defined by the holders 54*a, b*, so that the end portions 56*a, b* of the holders face inward toward plug 60. In order to insert the engagement members, the legs 22*a, b* may have to be pulled slightly apart by the user. The bail and bushing are positioned vertically, in the y-direction, upon insertion of the engagement members into the holders as shown in FIGS. 3B and 4. The bushing and bail are thereafter rotated in a downward direction as indicated by arrow C in FIG. 6 over the power cord. In the present embodiment, the design of the arcuate holders 54*a, b* and the engagement members allows the bail to be installed only when in the vertical position. Once the bail is rotated horizontally, the ends 154 can no longer be inadvertently removed from the arcuate shaped holders. As will be appreciated, after the bail and bushing have been rotated downward, the power cord 12 is secured to the electronic assembly.

Figure 7:
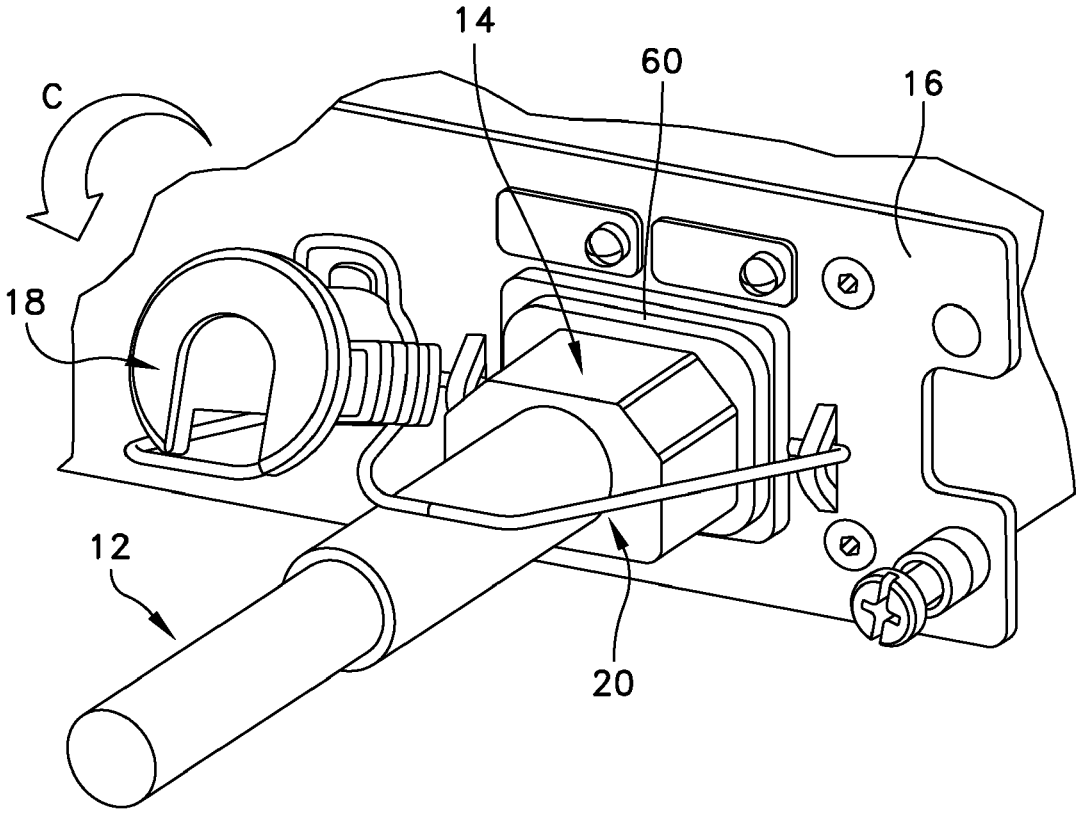
FIG. 7 is a perspective view of the adjustable retainer and power cord of FIG. 7 upon insertion of the cord into a socket of the chassis.
Figure 8:
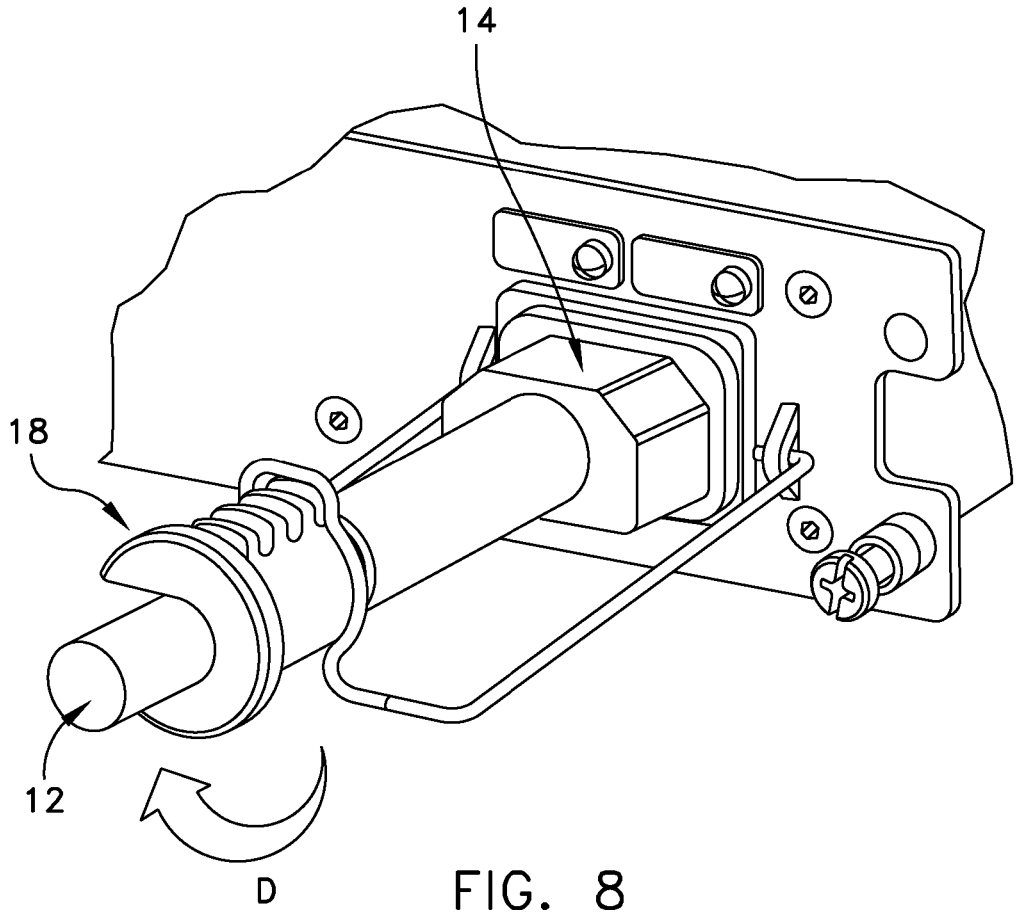
FIG. 8 is a perspective view of the adjustable retainer of FIG. 1 being secured to the cord.
Figure 9:
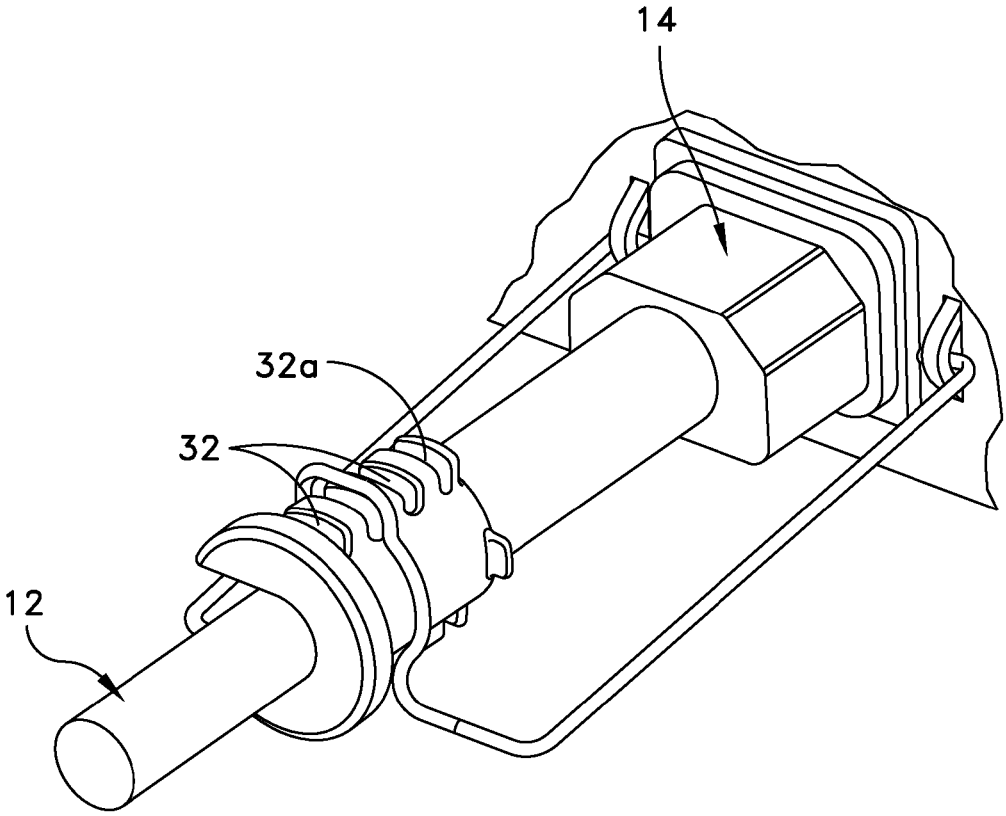
FIG. 9 is an enlarged, perspective view of the adjustable retainer and cord of FIG. 8 showing adjustment of the bushing.
Figure 10:
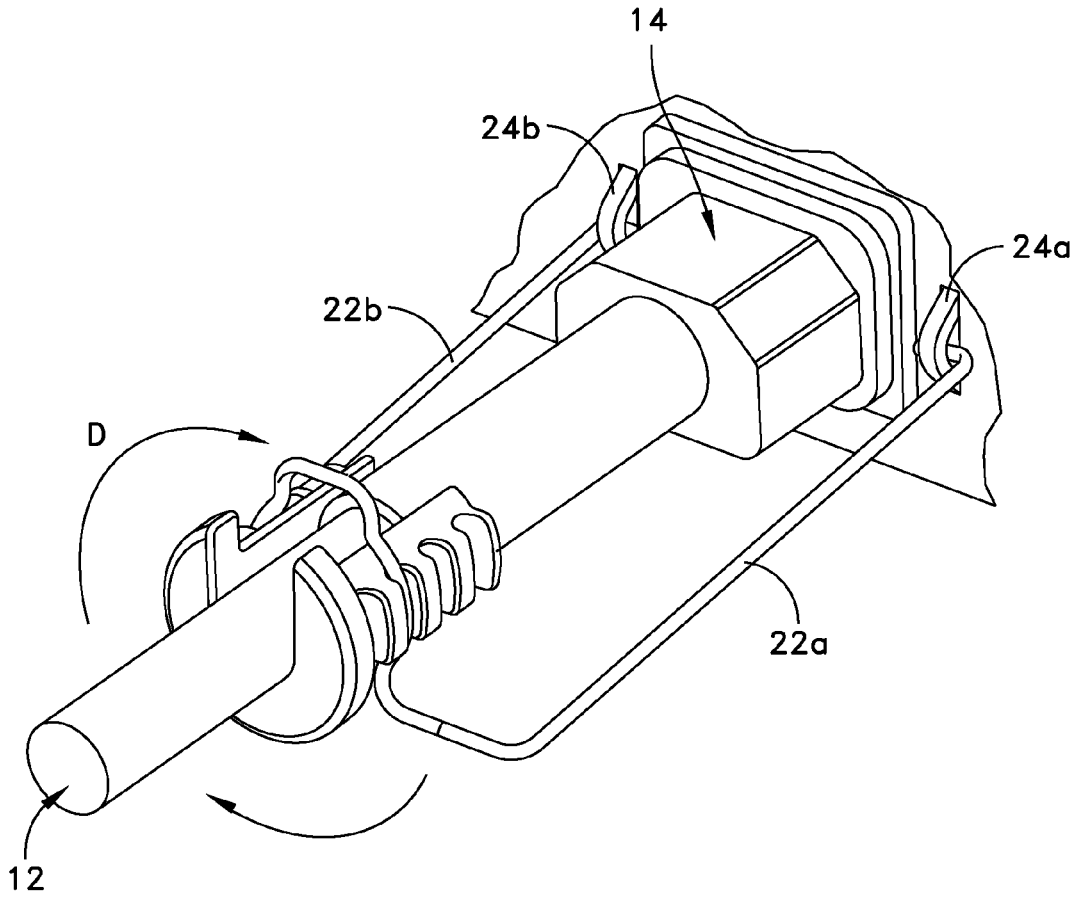
FIG. 10 is an enlarged, perspective view of the adjustable retainer and cord of FIG. 8 showing rotation of the bushing.
Figures 11, 12:
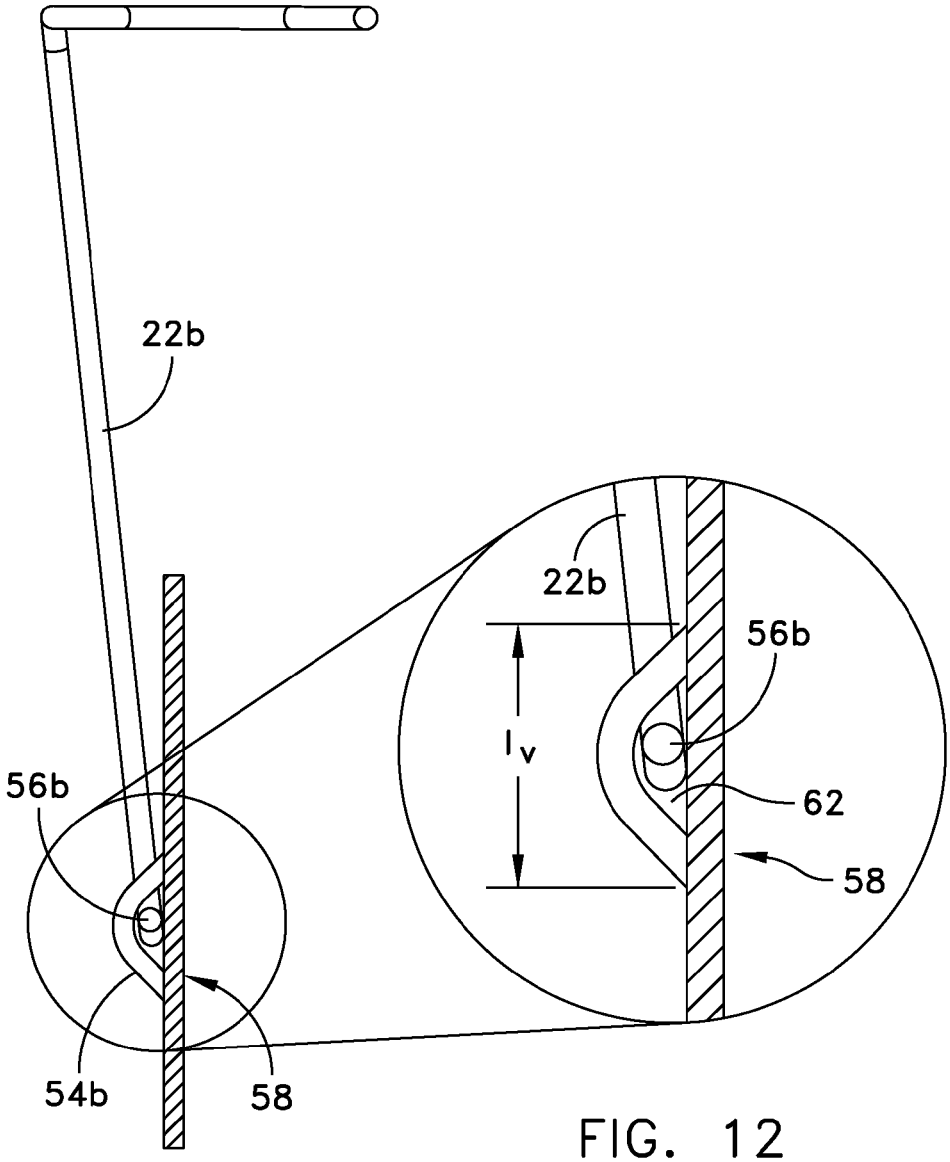
FIG. 11 is a side plan view in partial cross section of the bail of the adjustable retainer of FIG. 4 showing the bail in the upright position secured to the D-shaped holder.
FIG. 12 is an enlarged view of the bail of FIG. 11 being secured to the D-shaped holder.

As shown in FIG. 7, the plug 14 of the power cord is received within the receptacle 60 of the electronic device, under the bail 20. The bushing and bail are then rotated downward in the direction of arrow C until the cable 17 is received within the channel 30 of the bushing. The bushing 18 is then rotated in the direction of arrow D (FIG. 8) to prevent the cable from slipping out of the channel. The bushing 18 is then slid in the direction toward the bail 20, such that the flattened top portion 34*a* of the bail is supported within the slot 32 that provides the tightest fit against the power cord. The bushing 18 is then rotated further in the direction of arrow D until the opening 30 of the bushing faces upward (FIG. 10). To remove the retainer, the operation is reversed and the bushing 18 is slid and rotated to remove it from the power cord, the bail and bushing are rotated into the vertical position, and the bail is disengaged from the holder. The operation of securing the power cord by the retainer and removing the retainer can be accomplished by a single user, often with one hand, without the use of specialty tools.

Figure 13:
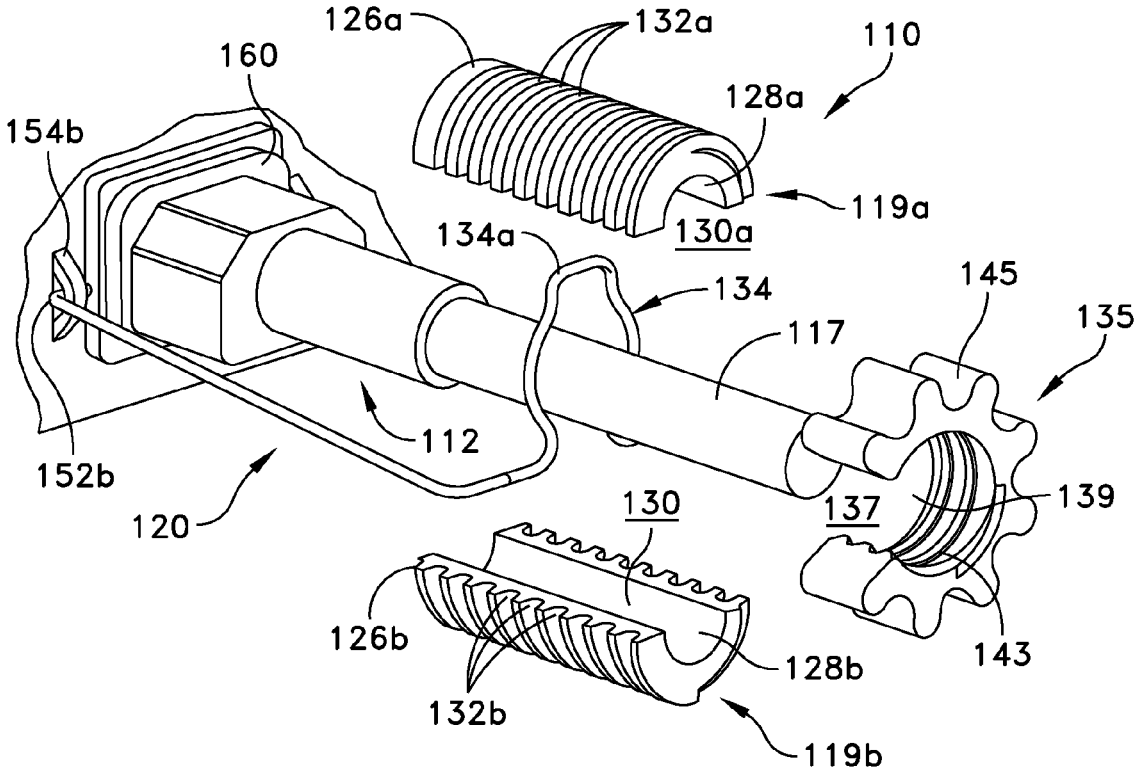
FIG. 13 is an exploded view of a second embodiment of an adjustable retainer for a power cord including a bushing, bail and locking ring.
Figure 14:
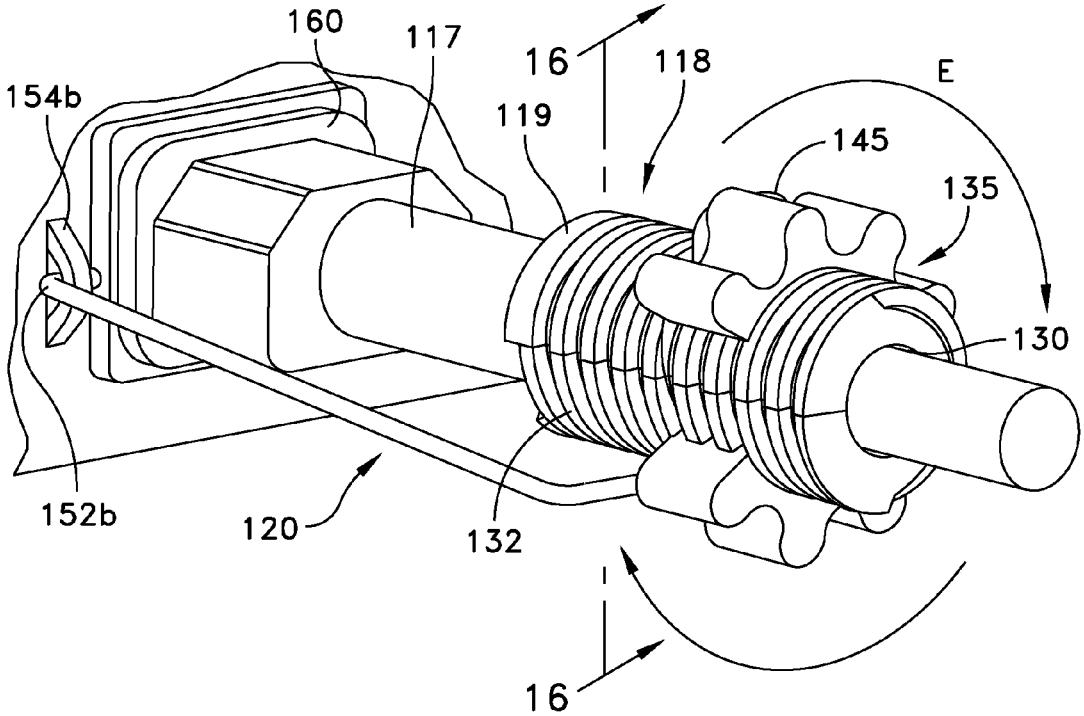
FIG. 14 is a perspective view of the embodiment of FIG. 13 secured to the cord showing rotation of the locking ring.
Figure 15:
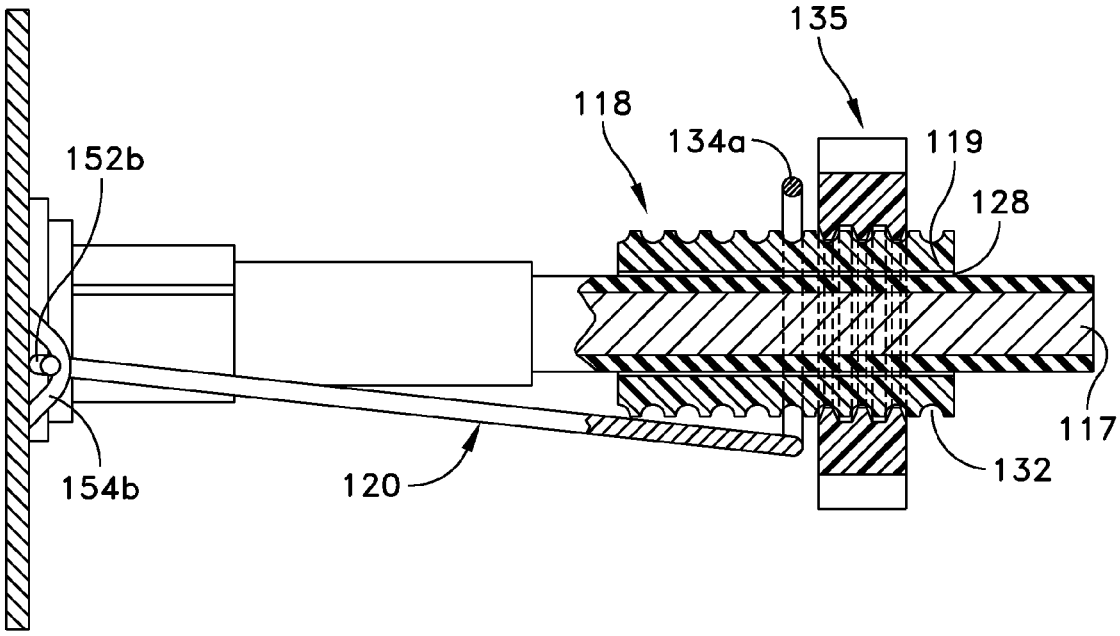
FIG. 15 is a side plan view of the embodiment of FIG. 14 with the bushing, ring and parts of the cord and bail in cross-section.

Referring now to FIGS. 13-15, a second embodiment of an example retainer 10 to stabilize the cord within a plug 60 of an electronic device 16 is illustrated. In this embodiment, the bail 20 is the same as described with respect to FIGS. 1-12, but the bushing has a different configuration. Therefore, the following description shall be made primarily with reference to the bushing, and members similar to those of the first embodiment shall be preceded with the reference numeral "1". As shown in the figures, housing 119 of bushing 118 includes two or more sections 119*a*, 119*b*, each including an inner surface 128*a, b* defining a channel 130*a, b*, and an outer surface 126*a, b* including slots or grooves 132*a, b* formed therein. The sections 119*a*, 119*b* are designed to be secured around the cord during use, and matingly engage each other, for example in a snap-fit arrangement. When attached, the inner surfaces 128*a, b* of the sections 119*a*, 119*b* form a continuous inner surface 128 that includes an elongated channel 130, defined by the channels 130*a, b* of each half, which encloses a portion of the cable 117 during use. The outer surface 126*a, b* of each section 119*a*, 119*b* includes slots or grooves 132 formed therein which are configured as a threaded connection such that, upon securing sections 119*a*, 119*b* together, a continuous threaded groove 132 is formed in the outer surface 126. The threaded groove 132 is engaged by the top portion 134*a* of the bail during use to provide adjustment of the bushing over the cord, as described above with respect to the first embodiment, and is also engaged by locking ring 135.

In the present embodiment, locking nut or ring 135 is designed to fit over the housing 119 after sections 119*a*, 119*b* are secured together over cable 117. The locking ring 135 may have a generally "C" shape, including an opening 137 for sliding the ring over the cable 117 after the housing 119 has been secured over the cable. The ring also defines an opening 139 sized to fit over the outer surface 126 of the assembled housing 119. The inner surface of the ring includes a threaded groove 143 that matingly engages the continuous threaded groove 132 of the housing 119 during use. The ring 135 may also include a knurled outer surface 145 to aid in griping and turning the ring during use. The threaded ring is pushed over the cable and threaded onto the bushing during use until it abuts the bail so as to secure the busing and bail over the cable, as described below.

Use of the retainer will now be described with reference to FIGS. 13-15. In use, The engagement members 152*a, b* of the bail are inserted from an outboard side into the openings 162 defined by the holders 154*a, b*, so that the end portions 156*a, b* of the holders face inward toward receptacle 160, as described above with respect to FIGS. 1-12. In this embodiment, the bushing has not yet been inserted over the cable and only the bail is positioned vertically, in the y-direction, upon insertion of the engagement members into the holders. The power cord 112 is inserted within the receptacle and the bail 120 is rotated in the downward direction over the cord (FIG. 13). The two sections 119*a*, 119*b* are then positioned over the cable 117 and are secured together such that the cable 117 is received within channel 130. The flattened top portion 134*a* of the bail is positioned within the groove 132 and may be adjusted within the groove by moving the bushing. The opening 137 of the locking ring 135 is slid over the cable 117 and the ring is positioned over the housing 119 so that the grooves of the inner surface 141 of the locking ring 135 engage the grooves 132 on the outer surface of the housing 119. The locking ring 135 is then rotated in the direction of arrow E (FIG. 14) until the ring abuts the support element 134 of the bail and is continues to be rotated to tighten the fit over the cord. To remove the retainer, the operation is reversed and the ring 135 is rotated in the opposite direction to loosen it and removed it from over the cord. The housing 119 is removed from the cable by taking sections 119*a*, 119*b* apart, and the bail is rotated into the vertical position, and disengaged from the holder. The operation of securing the power cord by the retainer and removing the retainer can be accomplished by a single user, often with one hand, without the use of specialty tools.

While various embodiments of the invention have been particularly shown and described, it will be understood by those skilled in the art that various changes in form and details may be made therein without departing from the spirit and scope of the invention as defined by the appended claims.

For example, the materials disclosed herein may be readily changed, as may the dimensions and geometric configurations of the bushing and bail. In addition, although the ribs are shown as extending from and supported on the outer surface of the bushing, the slots may be formed within the surface of the bushing so that the ribs are flush with the outer surface.

What is claimed is:

1. A power cord retainer assembly comprising:

a bushing having a housing with an outer surface and an inner surface, the inner surface defining a channel configured and dimensioned to receive the power cord therein, the outer surface including one or more interconnected slots formed thereon so as to form a threaded outer surface of the housing;

a bail having a support element constructed and arranged to maintain the bail within one of the slots of the bushing and defining an opening configured and dimensioned to receive the bushing therein, and a pair of opposing legs, each leg including a proximal end supported by the support element and extending there from, and a distal end;

an engagement member extending from the distal end of each leg, the engagement member facing inwardly, in a direction toward the opposite leg;

a first holder and a second holder constructed and arranged to receive a corresponding engagement member, the first holder being positioned on one side of the plug and the second holder being positioned on the other side of the plug; and wherein the engagement member of each leg is inserted within the corresponding holder from an outboard side of the holders so as to receive the engagement portions within the holders in a direction facing inward, toward the socket, and are rotated to position the bail over the cord, the cord being inserted within the channel of the bushing and into the socket, to secure the cord within the socket by the bail supported at one end within one of the slots of the bushing, and at the other end by each of the engagement portions received within the holders and facing inward, toward the socket.

2. The power cord retainer assembly of claim 1, wherein each engagement member terminates in an end portion extending there from, each end portion being bent at an angle so that the end portions extend further inward toward the other leg with respect to the body.

3. The power cord retainer assembly of claim 2, wherein the holders each have an arcuate shape that defines an opening between the holder and the chassis, the opening being sized to receive the end portion of the engagement members, and wherein the end portions of the engagement members are insertable within the openings when the legs are disposed in a substantially vertical position relative to the chassis, and upon rotation of the legs into a substantially horizontal position the end portions of the engagement members are secured within the openings and cannot be removed without rotation toward the substantially vertical position.

4. The power cord retainer assembly of claim 1, wherein the bushing includes a collar constructed and arranged to abut the support element when the support element is supported in the distal most slot.

5. The power cord retainer assembly of claim 1, wherein the bushing housing has a continuous inner surface that encloses the channel.

6. The power cord retainer assembly of claim 5, wherein the housing includes two or more sections constructed and arranged to matingly engage each other so as to form the continuous inner surface.

7. The power cord retainer assembly of claim 1, further comprising a locking ring having a threaded inner surface constructed and arranged to engage the threaded outer surface.

8. A power cord retainer comprising:

a bushing having a housing with an outer surface and an inner surface, the inner surface defining a channel configured and dimensioned to receive the power cord therein, the outer surface including one or more slots formed thereon;

a bail having a support element constructed and arranged to maintain the bail within the one or more slots of the bushing, and defining an opening configured and dimensioned to receive the bushing therein, and a pair of opposing legs, each leg including a first end supported by the support element and extending there from, and a second end, opposite the first;

an engagement member extending from the distal end of each leg and constructed and arranged to engage a corresponding holder supported on either side of a socket of the electronic device; and an adjustable locking member having an inner surface constructed and arranged to engage the outer surface of the bushing;

wherein during use the locking member engages the bushing and is selectively moved along the housing in order to tighten the fit between the bushing and the cord during use.

9. The power cord retainer of claim 8, wherein the housing includes two or more sections constructed and arranged to matingly engage each other so as to form the continuous inner surface.

10. The power cord retainer of claim 8, wherein the one or more slots are interconnected so as to form a threaded outer surface.

11. The power cord retainer of claim 10, wherein the locking ring includes a threaded inner surface constructed and arranged to engage the threaded outer surface.

12. The power cord retainer of claim 8, wherein the engagement member faces inwardly, in a direction toward the opposite leg and wherein during use the engagement member of each leg is inserted within the corresponding holder from an outboard side of the holders so as to receive the engagement portions within the holders in a direction facing inward, toward the socket.

13. A method of securing a power cord to an electronic device by a retainer comprising the steps of:

providing a bushing having a housing defining a channel on an inner surface and including one or more slots disposed on an outer surface;

providing a bail including an support element and a pair of legs having a first end adjacent the support element and a second end, opposite the first, and an engagement member extending inwardly from the second end of each leg, toward the opposing leg;

inserting the engagement members into corresponding holders supported on the electronic device from an outboard side of the holders, the engagement members facing toward each other;

inserting the cord within the electronic device;

rotating the bail toward the cord;

inserting the cord within the bushing;

inserting the support element of the bail within a slot of the bushing; adjusting the support element along the one or more slots of the bushing so as to tighten the bushing around the cord; and rotating the bushing over the cord to secure the cord within the bushing.

14. The method of claim 13, further comprising the steps of:

providing a locking ring including a threaded inner surface;

inserting the locking ring over the cord and housing;

rotating the locking ring to threadingly engage the inner surface of the locking ring with the outer surface of the bushing.

15. The method of claim 13, wherein the step of inserting the cord within the bushing comprises securing a first section of the housing over the cord and a second section of the housing over the cord and engaging the first section with the second section.

16. The method of claim 13, further comprising the step of pulling the legs apart to insert the engagement members within the holders.

17. The method of claim 13, further comprising the step of sliding the bushing in a direction toward the bail in order to tighten the fit against the cord.

18. A power cord retainer assembly comprising:

a bushing having a housing with an outer surface and an inner surface, the inner surface defining a channel configured and dimensioned to receive the power cord therein, the outer surface including one or more slots formed thereon;

a bail having a support element constructed and arranged to maintain the bail within one of the slots of the bushing and defining an opening configured and dimensioned to receive the bushing therein, and a pair of opposing legs, each leg including a proximal end supported by the support element and extending there from, and a distal end;

an engagement member extending from the distal end of each leg, the engagement member facing inwardly, in a direction toward the opposite leg;

a first holder and a second holder constructed and arranged to receive a corresponding engagement member, the first holder being positioned on one side of the plug and the second holder being positioned on the other side of the plug; and wherein the channel of the bushing is aligned with the opening of the support element in a first position in order to insert the cord within the channel of the bushing, the bushing being thereafter rotated into a second position where the channel is positioned adjacent the engagement portion to secure the cord within the socket by the bail at one end, and at the other end by each of the engagement portions received within the holders.

19. The power cord retainer assembly of claim 18, wherein each engagement member terminates in an end portion extending there from, each end portion being bent at an angle so that the end portions extend further inward toward the other leg with respect to the body.

20. The power cord retainer assembly of claim 19, wherein the holders each have an arcuate shape that defines an opening between the holder and the chassis, the opening being sized to receive the end portion of the engagement members.

21. The power cord retainer assembly of claim 20, wherein the end portions of the engagement members are insertable within the openings when the legs are disposed in a substantially vertical position relative to the chassis, and upon rotation of the legs into a substantially horizontal position the end portions of the engagement members are secured within the openings and cannot be removed without rotation toward the substantially vertical position.

* * * * *

UNITED STATES PATENT AND TRADEMARK OFFICE

CERTIFICATE OF CORRECTION

PATENT NO. : 7,513,791 B1
APPLICATION NO. : 11/951554
DATED : April 7, 2009
INVENTOR(S) : Gary McLeod It is certified that error appears in the above-identified patent and that said Letters Patent is hereby corrected as shown below:

On the Title page, Item (75) should read
-- (75) Inventor: Gary McLeod, Flagstaff, AZ (US). --

Signed and Sealed this

Twenty-sixth Day of May, 2009

JOHN DOLL
*Acting Director of the United States Patent and Trademark Office*